United States Patent [19]

Hays et al.

[11] 3,972,195

[45] Aug. 3, 1976

[54] TWO-PHASE ENGINE

[75] Inventors: Lance G. Hays, La Crescenta; David G. Elliott, La Canada, both of Calif.

[73] Assignee: Biphase Engines, Inc., La Crescenta, Calif.

[22] Filed: Dec. 23, 1974

[21] Appl. No.: 535,372

Related U.S. Application Data

[60] Division of Ser. No. 424,758, Dec. 14, 1973, Pat. No. 3,879,758, which is a continuation-in-part of Ser. No. 310,210, Nov. 29, 1972, abandoned.

[52] U.S. Cl. ..... 60/671; 60/649; 416/197 R; 416/243

[51] Int. Cl.[2] ..... F01K 25/06

[58] Field of Search ..... 60/649, 671, 651, 673; 416/197, 243

[56] References Cited

UNITED STATES PATENTS

| | | | |
|---|---|---|---|
| 2,151,949 | 3/1939 | Turner | 60/649 |
| 3,173,267 | 3/1965 | Takeda | 60/678 |
| 3,190,072 | 6/1965 | Berryer | 60/671 |

*Primary Examiner*—Allen M. Ostrager
*Attorney, Agent, or Firm*—William W. Haefliger

[57] ABSTRACT

A two-phase power source comprises a rotor; a nozzle having an outlet directed to discharge a two-phase jet for impingement on the rotor to rotate same, the nozzle having means to subdivide flow therein; and means to supply a heated first fluid in liquid state to the nozzle for subdivided flow therein toward said outlet and to supply a second and vaporizable fluid in liquid state to the nozzle to receive heat from the first fluid therein causing the second fluid to vaporize in the nozzle and mix with the first fluid in essentially liquid state to produce said discharging jet.

11 Claims, 23 Drawing Figures

FIG. 18.
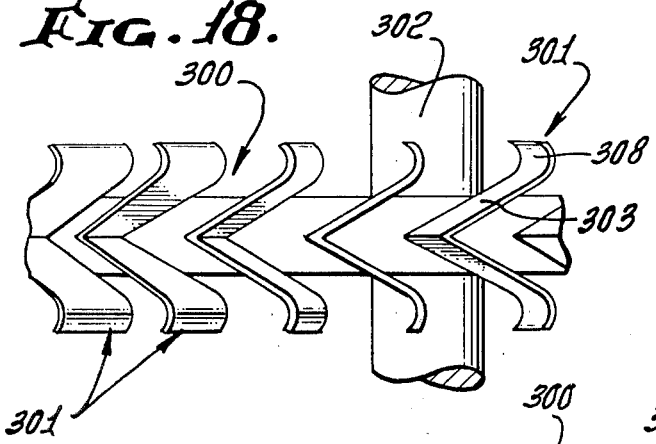
FIG. 19.
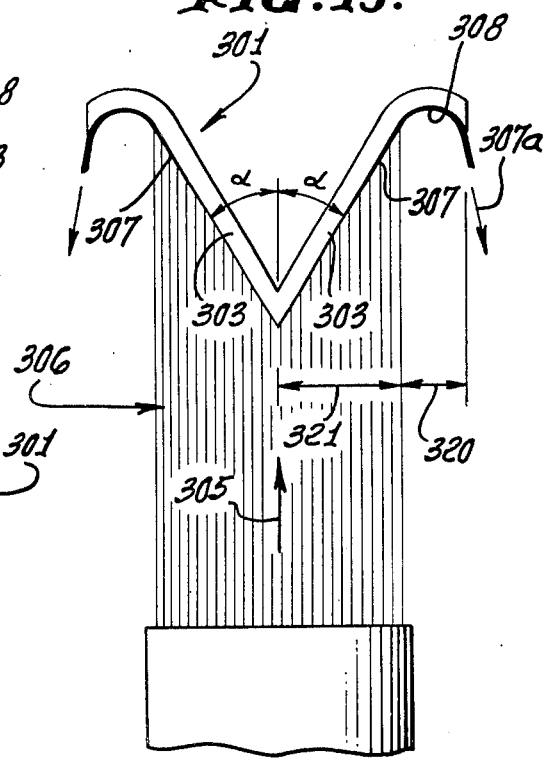
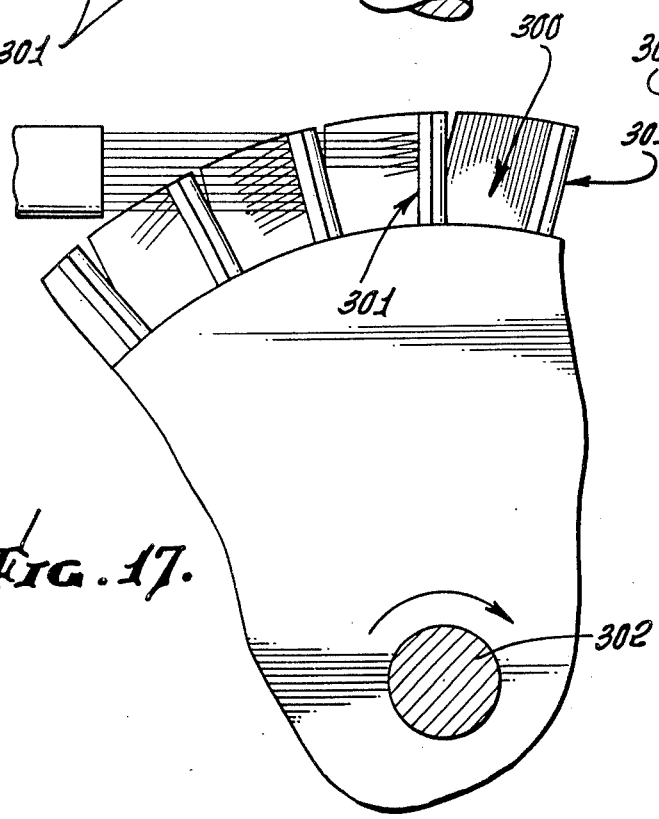
FIG. 17.
FIG. 20.
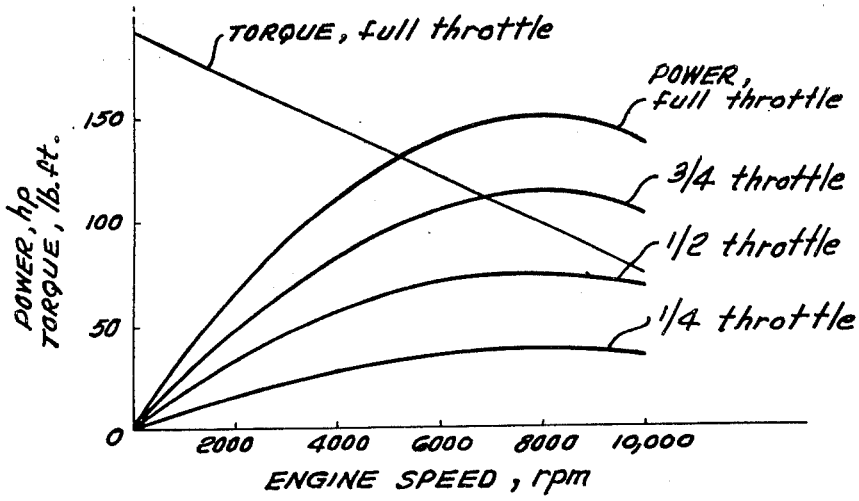

TWO-PHASE ENGINE

This application is a division of application Ser. No. 424,758, filed Dec. 14, 1973, now U.S. Pat. No. 3,879,758, which in turn is a continuation-in-part of our earlier application Ser. No. 310,210, filed Nov. 29, 1972, now abandoned.

BACKGROUND OF THE INVENTION

This invention relates generally to two-phase engines, and more specifically concerns the use of a gaseous or vapor fluid to accelerate a liquid to provide a mixture to drive a turbine or hydraulic motor at shaft velocities much lower than required in conventional gas or steam turbines, for the same power output.

There is a need for engines characterized by simplicity of construction and operation, low weight in relation to power output, low pollutant output in relation to conventional internal combustion engines and high torque at engine speeds from zero to the maximum design value. Gas and steam turbines do not meet all of these criteria since their very high rotary speeds necessitate relatively heavy speed-reducing mechanism or transmissions. While proposals toward meeting these criteria have been made in the past, none have embodied the many innovations of the present invention which make possible the provision of a highly efficient engine.

SUMMARY OF THE INVENTION

It is a major aspect of the invention to provide a two-phase (gas and liquid) engine capable of meeting all of the above requirements, as well as overcoming other problems encountered in this field. As will be seen, the engine is characterized by relatively low weight and low pollutant emission per given power output, and by output angular velocities that are much lower than those characteristic of gas and steam turbines.

Basically, and in one of its forms, the invention is embodied in a two-phase, power source that comprises a rotor; a nozzle having an outlet directed to discharge a two-phase jet for impingement on the rotor to rotate same; and means to supply a heated first fluid "A" in liquid state to the nozzle for subdivided flow therein toward the output and to supply a second and vaporizable fluid "B" in finely divided liquid state to the nozzle to receive heat from the A fluid causing the B fluid to vaporize in the nozzle and be expanded with the A fluid which remains in essentially liquid state to produce the discharging two-phase jet. Accordingly, no boiler or vaporizer for the B fluid is required, there is improved mixing of vapor and liquid in the nozzle, and the mass flow of the jet is sufficient to permit operation of the rotor at much lower velocities than are characteristic of gas and steam turbines. Also, heating of the A fluid as by an external combustion heater prior to fluid introduction to the nozzle permits achievement of low pollutant level output.

Additional objects of the invention include the provision of a first path to recirculate first fluid to the nozzle and in which the motor is connected, and a second path to recirculate the second fluid to the nozzle and containing a condenser; the provision of a second nozzle to receive A and B fluids from the casing for the rotor in such state that the second fluid expands further in the second nozzle whereby the first fluid velocity is increased and the second fluid may be separated in a gas-liquid separator; the provision of a diffuser to receive the high velocity first fluid to recover its kinetic energy as pressure sufficient to return the first fluid to a heater, whereby a separate pump is eliminated; the provision of a separator wheel and turbine wheel combination; and the application of the invention to power a vehicle.

It is a further object of the invention to provide a two-phase power source having first and second turbine rotors with separate shafts and power take-offs, each rotor receiving impingement of a two-phase jet from nozzle means as described; with pump means driven at approximately constant speed by one rotor power take-off for recirculating at least one of the A and B fluids to the nozzle means, and other loads also driven at approximately constant speed by the same rotor; and the other rotor power take-off being operatively connectible to a variable speed load, as for example a vehicle. A regenerative heat exchanger may be employed in this form of the invention, as will be seen.

A still further object of the invention is to provide a rotary separator acting as a gas-liquid separator, the rotary separator periphery being essentially bladeless and receiving impingement of the two-phase jet, and being free to rotate so that the velocity at the periphery is essentially equal to the jet velocity, with a duct or slit capturing liquid A which has impinged on the rotor for supply to a diffuser wherein kinetic energy may be converted to pressure in order to power a fluid motor, or otherwise cause liquid to be circulated.

It is another object of the invention to provide a two-phase power source characterized by supply to the nozzle of first fluid A in liquid state, and second fluid B consisting of hot products of combustion or compressed gas, the two fluids mixing in the inlet of the nozzle to produce the two-phase jet, as will be described.

These and other objects and advantages of the invention, as well as the details of illustrative embodiments will be more fully understood from the following description and drawings.

DRAWING DESCRIPTION

FIG. 1 is a schematic diagram of one preferred embodiment of the invention;

FIG. 1*a* is an elevation showing a vehicle powered by the power apparatus of the invention;

Figure 11:
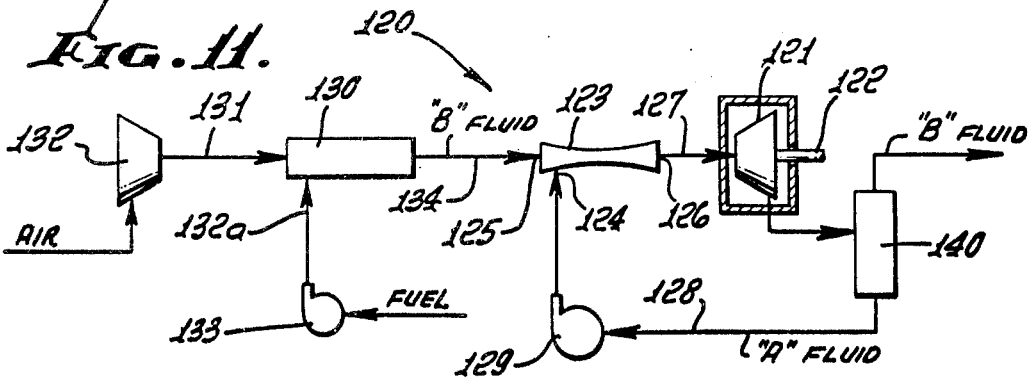
Figure 7:
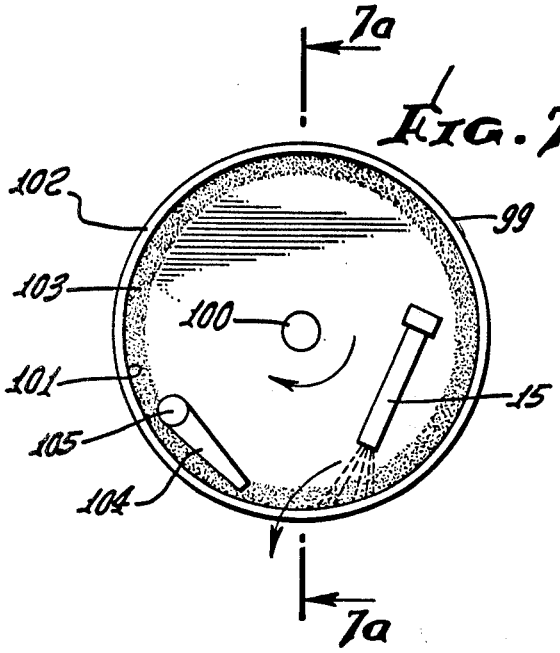
FIGS. 6 and 7 are elevations showing two types of separators usable in the invention.
Figure 7A:
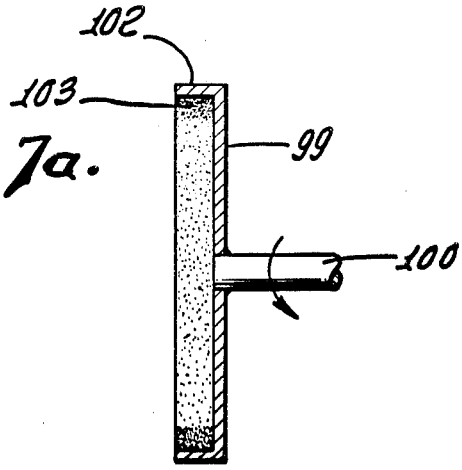
Figure 10:
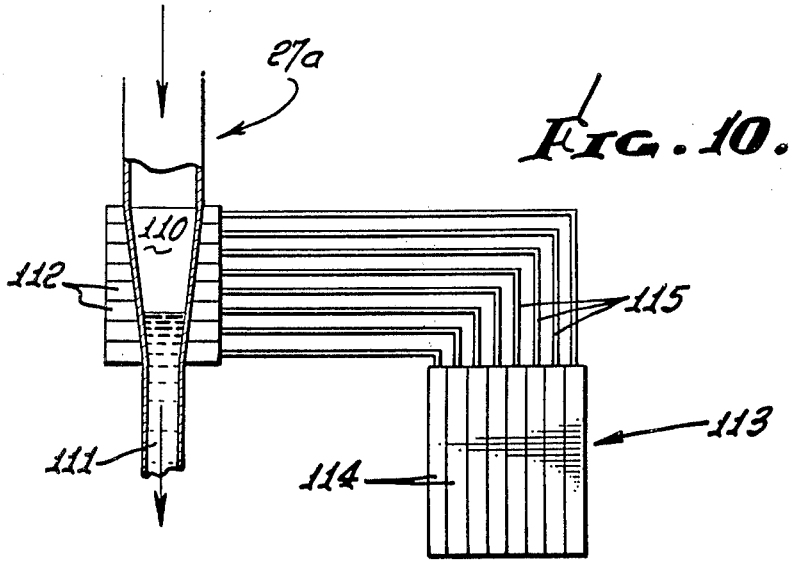
Figure 8:
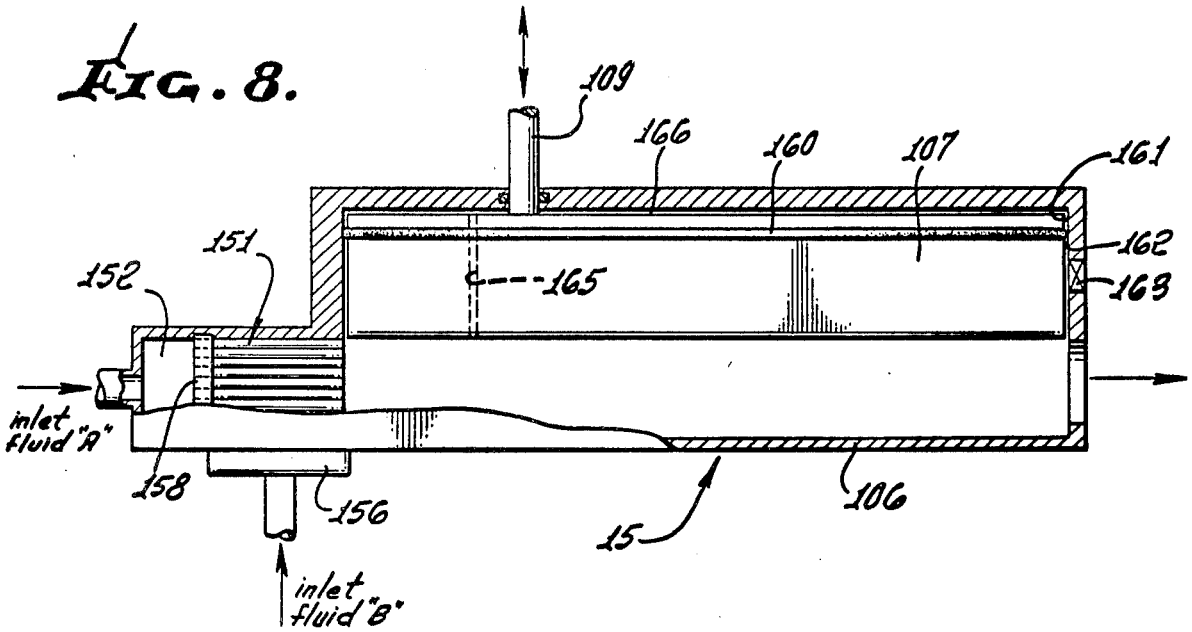
Figure 9:
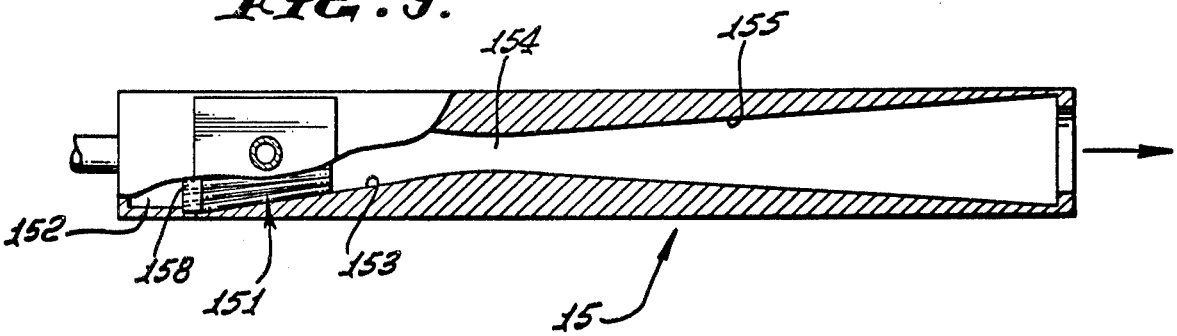
Figure 9A:
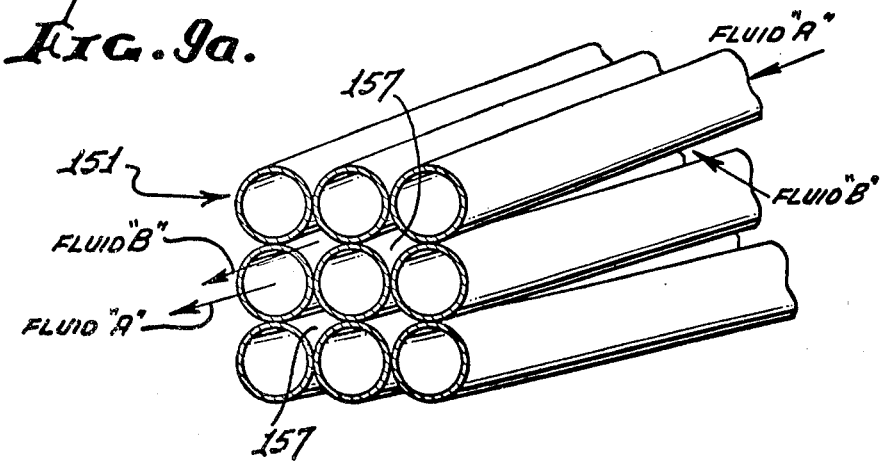
Figure 12:
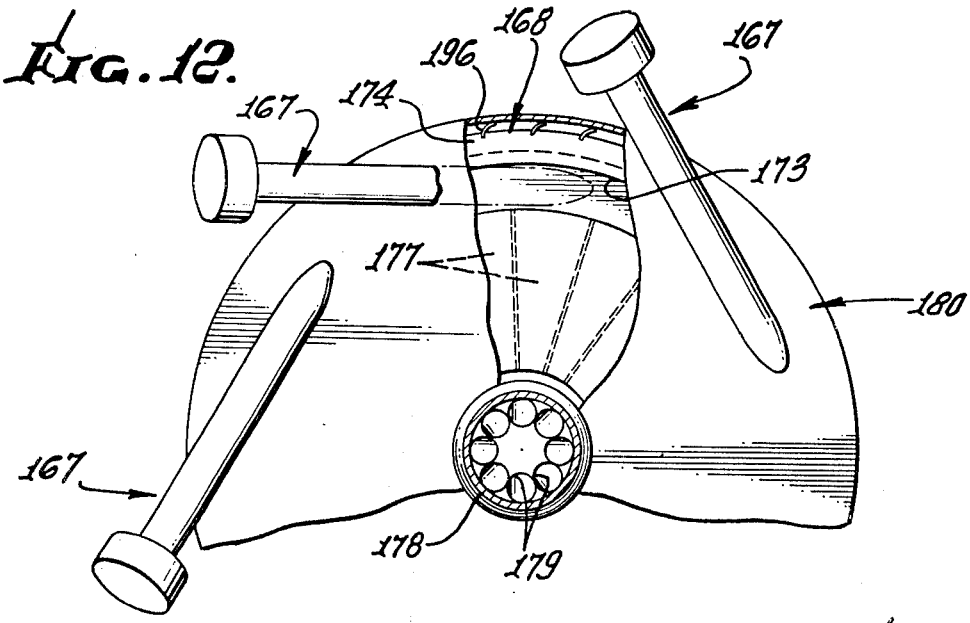
Figure 15:
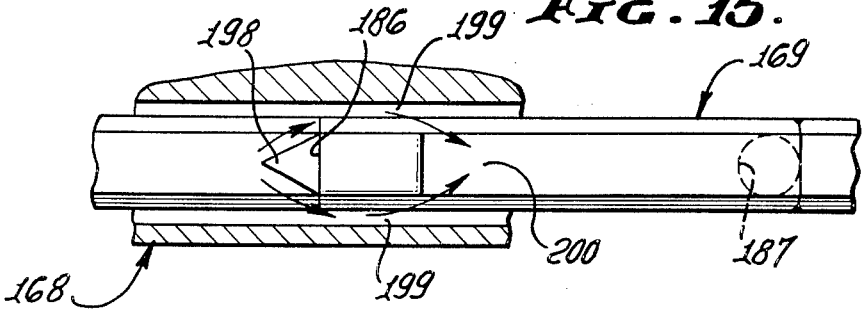
Figure 14:
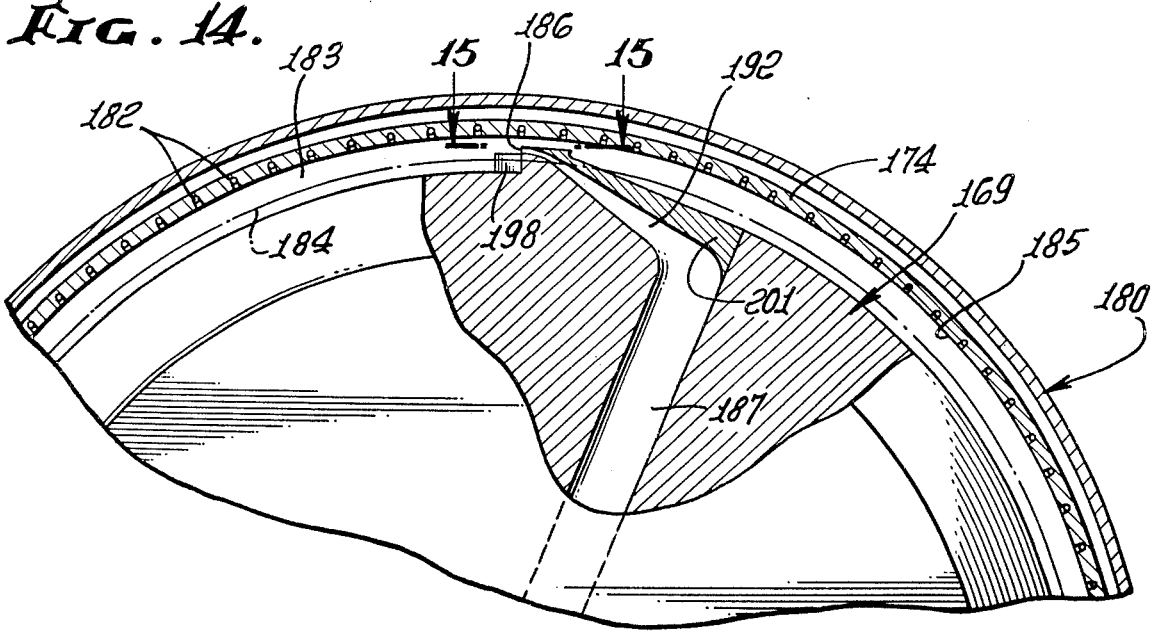
Figure 16:
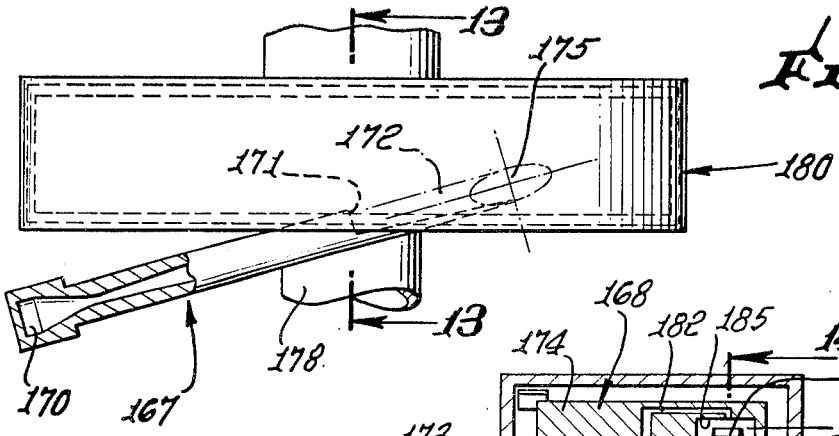
Figure 13:
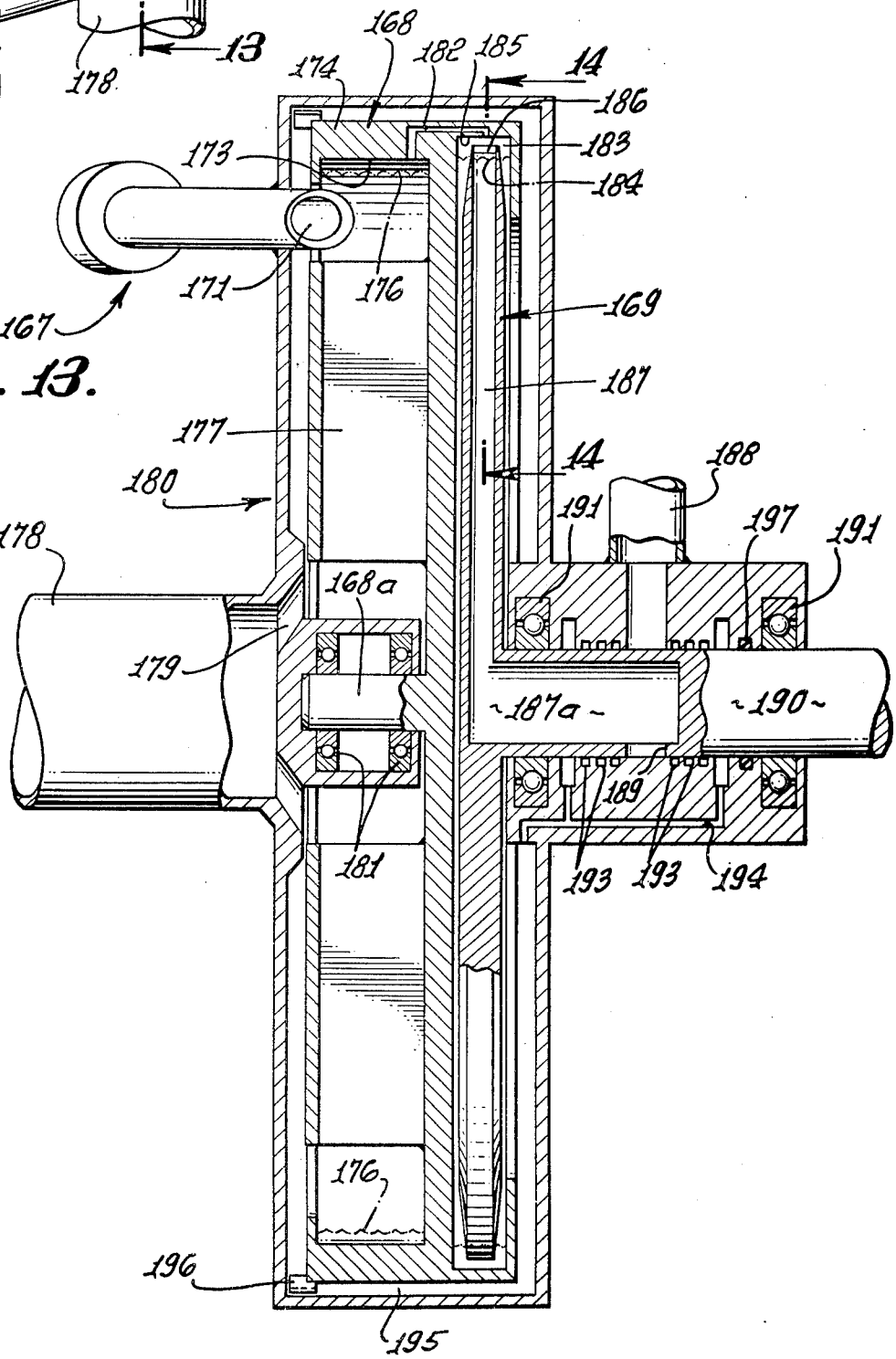

FIG. 7*a* is a section on lines 7*a*—7*a* of FIG. 7;

FIGS. 8 and 9 are elevation and plan views respectively of a two-phase nozzle;

FIG. 9*a* is a perspective view of nozzle injector structure;

FIG. 10 is a schematic of a segmented heat radiator;

FIG. 11 is a schematic of a further modification;

FIG. 12 is a side elevation of another form of two-phase engine;

FIG. 13 is an enlarged sectional elevation taken on lines 13—13 of FIG. 16;

FIG. 14 is a fragmentary section on lines 14—14 of FIG. 13;

FIG. 15 is an enlarged section on lines 15—15 of FIG. 14;

FIG. 16 is a top plane view, partly in section, of the FIG. 12 engine;

FIG. 17 is a schematic fragmentary side elevation of a two-phase turbine rotor;

FIG. 18 is a top plan view of the FIG. 17 rotor;

FIG. 19 is a schematic showing of jet impingement on the FIGS. 17 and 18 rotor, and of two-phase fluid separation therefrom; and FIG. 20 is a diagram of power and torque characteristics for the two-phase engine.

DETAILED DESCRIPTION

Figure 1:
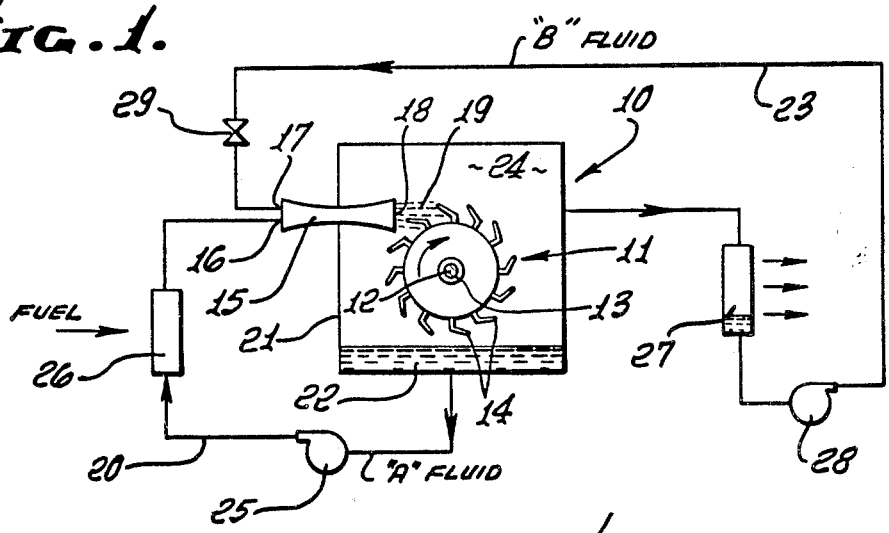
Figure 1A:
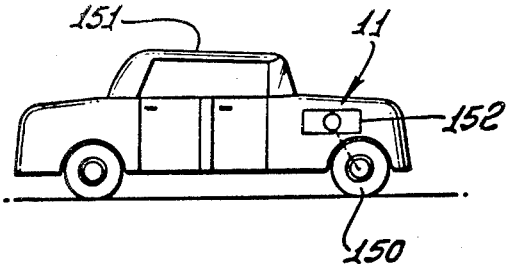

Referring first to FIG. 1, the two-phase power source or engine 10 includes a turbine rotor 11 rotatable about axis 12 to drive a power take-off shaft 13, and having peripheral blades 14. A nozzle 15 has inlets 16 and 17, and an outlet 18 directed to discharge a two-phase (gas and liquid) jet 19 for impingement on the blades to rotate the rotor. Such a rotor may be used to drive a wheel 150 of a vehicle 151 as seen in FIG. 1*a*, via a transmission 152, for example, or directly via the power take-off shaft.

Means is provided to supply a heated first fluid in liquid state to the nozzle inlet 16 for flow in the nozzle toward outlet 18, and to supply a second and vaporizable fluid in liquid state to the nozzle inlet 17 to receive heat from the first fluid causing the second fluid to vaporize in the nozzle inlet. Such vaporization results from intimate mixing of the second fluid, in liquid state, with the first fluid at the nozzle inlet by means of an injector structure as for example is shown in FIGS. 8, 9 and 9*a* at 15. As there illustrated, the injector structure comprises many small tubes 151 to subdivide and pass the fluid A entering the tubes via a plenum chamber 152*a* in the nozzle passage. Note that the tubes are located in the convergent portion 153 of the nozzle passage, the latter also have a throat 154 and a divergent portion 155. A transverse plate 158 in the passage supports the tubes at their entrances and closes the spaces therebetween.

The second or B fluid is supplied via a plenum 156 to the cusps 157 formed between the tubes, for subdivided flow through the cusps toward the nozzle throat, to intimately contact and mix with the A fluid. Such vaporization produces even finer droplets, which results in efficient coupling between the liquid droplets and the vapor as the vapor is expanded in the nozzle to a lower pressure and accelerated to a higher velocity at the nozzle exit, dragging the first fluid to a similar higher velocity. The mixture then impinges on the rotor blades causing the turbine rotor to turn and converting jet energy to shaft energy.

More specifically, such means includes a first path, (as for example at 20) for first fluid recirculation to the nozzle from a rotor casing or housing 21 wherein the first fluid collects in a pool or annular film at 22 after separation from the rotor blades; and a second path (as for example at 23) for second fluid recirculation to the nozzle from the interior 24 of the housing 21. A pump 25 and external combustion heater 26 may be connected in series with the first path 20, as shown; and a condenser 27, pump 28 and control valve 29 may be connected in series with the second path 23. The condenser operates to condense vaporized second fluid removed from the housing interior 24, and the pump pressurizes and circulates the condensed fluid for ultimate vaporization and expansion in the nozzle at reduced pressure; accordingly, a very compact system is achieved. With respect to the heater 26, heat may be supplied from steady, low-pressure, low temperature combustion of fuel, resulting in low exhaust emissions of harmful pollutants, or from any other suitable heat source. The first fluid A may for example consist of a hydraulic oil or heat transfer fluid and the second fluid B may consist of water, or other vaporizable fluid, fluid A having a lower vapor pressure than fluid B.

Figure 2:
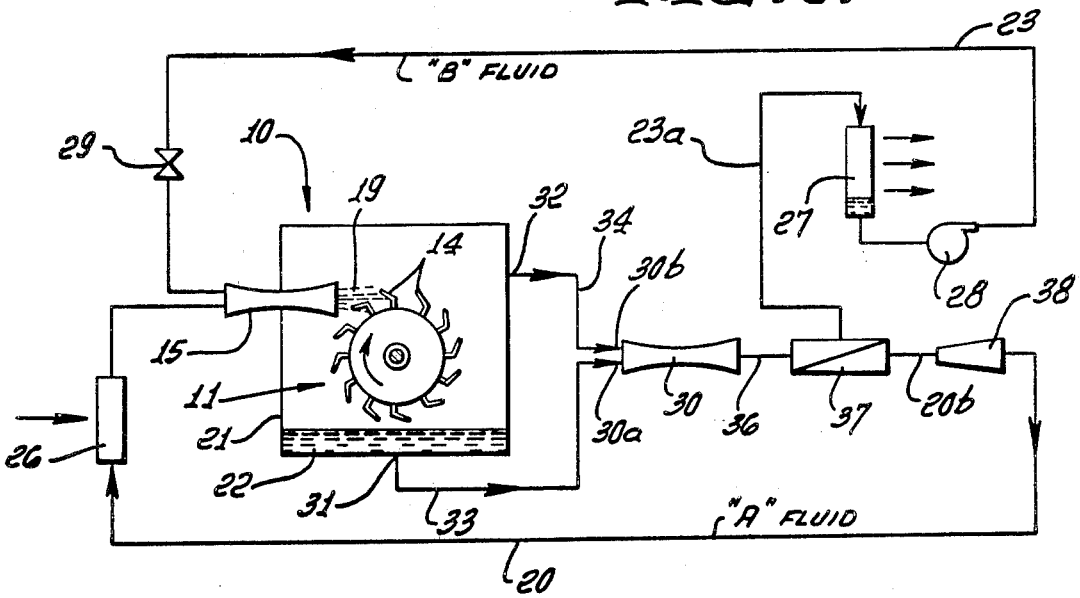
FIG. 2 is a schematic diagram of another embodiment of the invention.

The system shown in FIG. 2 is similar in principle to FIG. 1, excepting that the fluid supply means includes another nozzle 30 operating in series with the first nozzle and having inlets 30*a* and 30*b* communicating with the casing to receive the first and second fluids from casing outlets 31 and 32 via lines 33 and 34, respectively, for re-mixing. The second fluid, received by the nozzle in vaporized and intermediately pressurized state (for example around 35 psia) is expanded to low pressure (i.e. around 15 psia for example) and high velocity in the second nozzle 30. The exit stream from the latter is passed at 36 to a vapor-liquid separator 37 in which the vapor B is separated from the liquid A and passed at 23*a* to condenser 27. Separator 37 may comprise a surface inclined at an angle to the two-phase flow with a capture slot, or it may be of the rotating type discussed below. The high velocity liquid stream discharging from the separator is passed at 20*b* to a diffuser 38 where the kinetic energy of the liquid is recovered as pressure sufficient to return the first fluid to the heater 26. Accordingly, pump 25 is not needed, and system complexity and cost are reduced. Instead of the separator, the mixture exiting from the second nozzle may impinge on a second row of blades on the same rotor resulting in an even lower rpm.

Figure 3:
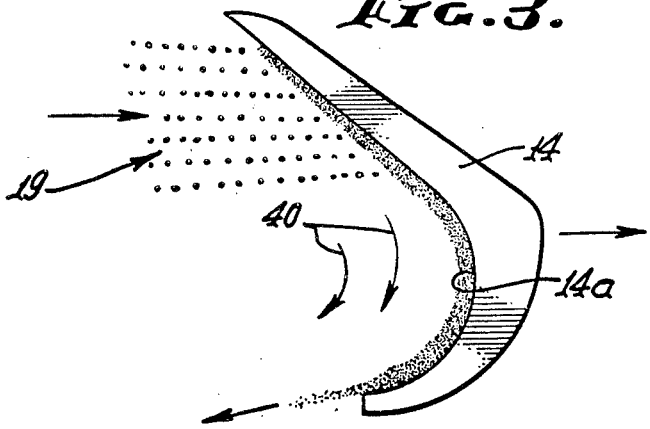
FIG. 3 is a section through a turbine blade.

FIG. 3 illustrates a typical turbine blade 14 in section, with concave curvature such as to separate the fluids A and B impinging thereon as two-phase jet 19. Note that first fluid A separates as a liquid film adherent to the blade concave surface 14*a*, whereas second fluid B separates as gas flow indicated by arrows 140.

Figure 4:
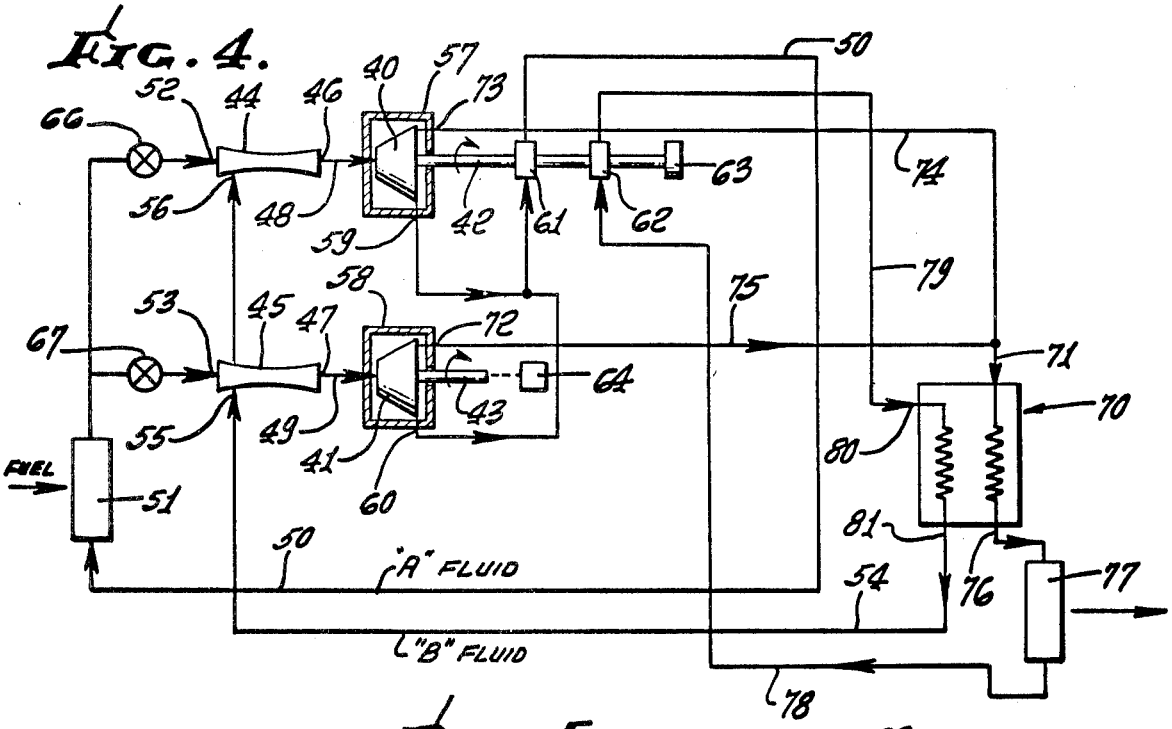
FIGS. 4 and 5 are schematic diagrams of further embodiments of the invention.

In FIG. 4, first and second rotors or turbines 40 and 41 have suitable blades, as described previously, as well as power take-offs such as shafts 42 and 43. First and second nozzles 44 and 45 have outlets 46 and 47 respectively directed to discharge two-phase (gas and liquid) jets 48 and 49 for impingement on the blades of the respective turbines to rotate them. Means is provided to supply a heated first fluid A in liquid state to each nozzle for flow therein toward the nozzle outlet, such means for example including duct or path 50 containing an external combustion heater 51, for example, and communicating with nozzle end inlets 52 and 53. Means is also provided to supply a second and vaporizable fluid B, as for example in liquid state, to each nozzle to receive heat from the first fluid in the nozzle causing the second fluid to expand in the nozzle and mix with the first fluid, which remains in essentially liquid state, to produce the discharging jets. Such means for example includes the duct or path 54 communicating with the nozzle side inlets 55 and 56.

Turbine casings are shown at 57 and 58, and first fluid collects therein and is withdrawn at 59 and 60 for return to path 50 via a pump 61 driven by the power take-off of turbine 40. The turbine 40 and its power take-off are operated at constant speed, to provide the most efficient operation of pump 61, a second pump 62 and any other auxiliary equipment 63 such as an air conditioner, alternator etc. The speed of turbine 40 is independent of the speed of turbine 41, enabling full flow and high torque over the entire range of engine speed. The turbine 41 and its power take-off 43 are allowed to vary in speed in accordance with the demands imposed by a variable speed load 64, as for example a vehicle drive. Fluid A flow control valves may be included at 66 and 67 in series with path 50 to control the flow of liquid mass to the nozzles in order to independently achieve the turbine velocities described. Another method, discussed below, is to control the throat area of the nozzle.

Also shown in FIG. 4 is a regenerative heat exchanger 70 having an inlet 71 connected with the vapor outlets 72 and 73 from the casings 57 and 58, as via paths 74 and 75. Second fluid leaves the heat exchanger via outlet 76 connected with a condenser 77 wherein second fluid is condensed as liquid and circulated at 78 to pump 62. The thus cooled and pressurized liquid is recirculated at 79 to path 54 via the heat exchanger (see inlet 80 and outlet 81) to cool the fluid vapor passing through the heat exchanger to the condenser, for higher efficiency.

Figure 5:
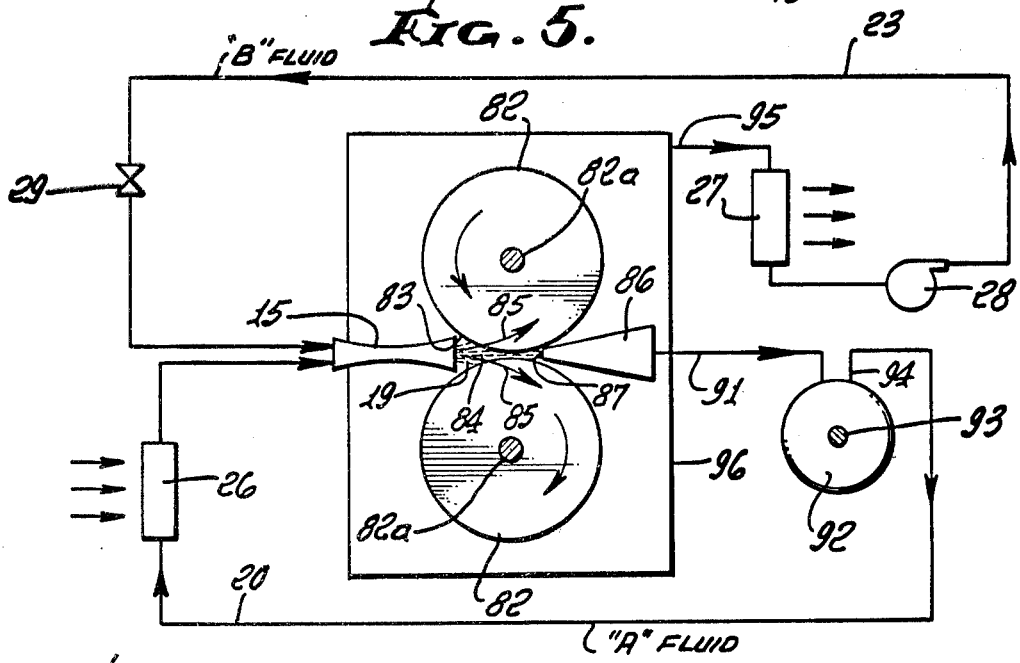
Figure 6:
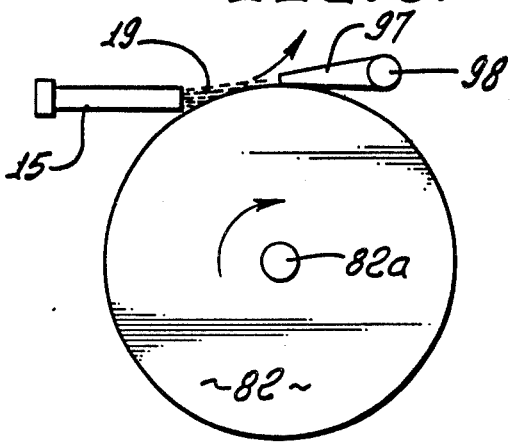

Referring to FIG. 5, the two-phase nozzle 15, heater 26 in path or line 20 and valve 29, condenser 27 and pump 28 in path or line 23 are the same elements as in FIG. 1. The rotor is a rotary separator in this form of the invention and comprises one or two wheels such as indicated at 82 and supported by shafts 82*a*. The two-phase jet 19 is directed at the wheel peripheries 83 as shown, and specifically to the gap 84 formed therebetween, whereby the wheel peripheries or surfaces are driven at velocities matching the jet velocity, to avoid excessive friction losses while separating the liquid from the gas. The wheel or wheels act as separators in that the vapor separates laterally as indicated by arrows 85, whereas the liquid phase is captured by means such as a diffuser 86, the inlet 87 of which is in the direct path of liquid travel on the rotor peripheries. No shaft power is obtained from the rotary separator. Typically, for a 1,200 psia nozzle inlet pressure, between 3,000 and 4,000 psia can be recovered in the diffuser, wherein the velocity head is converted to a pressure head. In FIG. 5 the high pressure liquid flows from the diffuser at 91 to and through a fluid motor 92 producing power at output shaft 93 due to the pressure drop in the motor. Enough pressure remains in the fluid A (liquid) discharging from the motor at 94 for return to the heater 26. The vapor consisting of fluid B and any fluid A carryover flows at 95 from the casing 96 to the condenser 27, and is condensed, pressurized at 28, and returned to the nozzle 15. FIG. 6 shows a single rotary separator wheel 82, usable in the FIG. 5 device, with a liquid A capture slot 97 with attached diffuser 98. FIGS. 7 and 7*a* show a modified rotary separator wheel 99 rotating on a shaft 100, and wherein the nozzle 15 is directed toward the inner periphery 101 of a wheel rim 102. A layer 103 of liquid A forms on that periphery, and a liquid capture slot 104 is located to receive liquid for flow to a diffuser 105 operating in the manner of diffuser 86 in FIG. 5.

In FIGS. 8 and 9, the nozzle 15 includes relatively movable body parts 106 and 107. Part 106 is U-shaped in cross-section and receives part 107, the latter being movable to increase or decrease the flow area and in particular the flow area at the nozzle throat 154 in order to keep the system temperature, pressure and nozzle area ratio constant, while changing mass flow rate. An actuator rod 109 connected with part 107 is movable for this purpose. Part 107 includes a peripheral seal 160 sealing off against inner wall 161 of body part 106 defining recess 162. Note thrust bearing 163 to receive endwise pressure exerted by part 107, and duct 165 through part 107 to conduct flow pressure to the back side 166 of the nozzle for equalization, facilitating control.

In FIG. 10 a modified condenser 27*a* usable in the above systems in place of condenser 27 includes a vapor duct 110 receiving vapor from the rotor casing, and discharging condensate at 111 for return to the two-phase nozzle. Separate fluid coolant ducts 112 extend in heat transfer relation with the duct 110, and a heat radiator 113 has segmented passages 114 in communication with the respective separate ducts 112 as via heat pipes 115. This arrangement isolates the radiator 113 from the vapor in the condenser in the event of rupture or puncture of any radiator segment.

Referring to FIG. 11, the modified two-phase power source 120 includes a turbine rotor 121 rotatable to drive a power take-off shaft 122. A nozzle 123 has inlets 124 and 125, and an outlet 126 directed to discharge a two-phase jet 127 for impingement on the rotor to rotate same.

Means is provided to supply a first fluid A in liquid state to the nozzle for flow therein toward the outlet. Such means may include a liquid path 128 in which a pump 129 is connected to supply the liquid (as for example hydraulic oil) to the nozzle. Means is also provided to supply a second fluid in the form of hot products of combustion or compressed gas to the nozzle to mix with the first fluid in essentially liquid state to produce the discharging jet. The latter means may for example include a steady state combustor 130 receiving compressed air at 131 as from an air compressor 132, and also receiving fuel at 132*a* as from a pump 133 for combusting the fuel to produce the second fluid at 134. In the nozzle the temperature of the liquid A is raised, the temperature of the hot products of combustion B is reduced, and the mixture is accelerated to a relatively high velocity for doing work in the turbine rotor. The latter, however, rotates at a much lower angular velocity than a conventional gas turbine, for the same power output, so that a much smaller speed reducing transmission may be employed. Further, since the temperature of the combustion products is relatively low after expansion through the nozzle, a lower than conventional percentage of harmful polluting constituents is produced, and a nearly isothermal expansion process is employed, increasing efficiency.

A gas-liquid separator 140 is shown as connected with the turbine discharge to receive the first and second fluid mix and to separate the two fluids, the liquid A being recycled at 128 to the nozzle. Fluid B may be discharged to atmosphere. A particularly effective separator for FIG. 11 is one of the rotary separators discussed previously.

FIGS. 12–16 show another design of a two-phase turbine engine, including nozzles 167, separator wheel 168 rotating within casing 180, and radial-flow turbine 169, shown as coaxially rotatable within the casing. The liquid and gas mixture comprising the working fluid, as previously described, is supplied at high pressure to the nozzle inlets 170. The mixture expands to low pressure at the nozzle exits 171, and the resulting high-velocity two-phase jets 172 impinge on the inner surface 173 of the rim 174 of the rotating separator at locations 175, seen in FIG. 16. The liquid becomes concentrated in a layer 176 on the inner surface 173 due to the inertia of the liquid and to centrifugal force, while the gas separates and flows radially inward through passages 177 and enters the gas discharge pipe 178 through ports 179 in the stationary casing or housing 180. The rotating separator is supported by bearings 181 mounted in the housing 180, and receiving a separator wheel axle 168*a*.

The rotation of the separator 168 is impeded only by windage and bearing friction losses which can be very small. Thus only a very small relative velocity between the impinging jet 172 and the surface 173, aided by the torque imparted to the rotating separator by the inward flow of the gas through passages 177, serves to maintain the speed of the liquid layer 176 at a value nearly equal to that of the jets 172.

The liquid flows from the liquid layer 176 through passages 182 in the rim of the rotating separator 168 and then into annular chamber 183 which forms an integral part of the separator wheel 168. As a result another liquid layer 184 is formed, held against the surface 185 by centrifugal force. This layer furnishes the fluid energy source for the turbine rotor 169 rotating concentrically within the separator wheel and having turbine inlet passages 186 immersed in the liquid layer 184.

The turbine 169 may have blades or passages arranged to intercept the liquid layer 184, and FIGS. 13 and 14 show a radial-flow type turbine. The turbine rotor 169 typically rotates at a lower angular velocity than the separator wheel 168, causing liquid from the layer 184 to enter the inlets 186, flow radially inward through passages 187, and flow to liquid outlet pipe 188 via axial passage 187*a* in shaft 190 and apertures 189 in the wall of the turbine shaft 190. The shaft 190 is connected to the load to be driven. The turbine 169 is supported on bearings 191.

Each turbine passage 187 can optionally incorporate a diffuser 192 in which the velocity of the liquid entering inlet 186 can be partially converted to pressure such that, even allowing for the pressure drop in the radial passages 187 due to centrifugal force, the liquid pressure in discharge pipe 188 is substantially higher than the pressure in the turbine casing 180, and, in fact, greater than the pressure at the nozzle inlets 170. Thus the diffusers 192 can supply the necessary pumping of the liquid, eliminating the need for a separate pump to return the liquid to the nozzles.

For operation with high pressure at the discharge 188 the leakage of liquid between the shaft 190 and the housing 180 is reduced by labyrinth seals 193 and drains 194 which return liquid leakage to the bottom 195 of the housing 180, where the liquid from this and other internal leakage sources is picked up by slinger blades 196 and thrown back into the jets 172. Leakage to the outside of housing 180 is prevented by a shaft seal 197.

The external shape of the turbine inlet ports 186 must be such as to minimize external drag and turbulence that could disturb and retard the liquid layer 184. The design shown in FIG. 15 employs a wedge-shaped strut 198 for the portion of the turbine inlet which intercepts the surface of the liquid layer 184 so that the flow intercepted by the strut is split at 199 with minimum disturbance and returned with little velocity loss to the liquid layer in the wake region 200 behind the turbine inlet 186.

To allow for operation of the engine at different liquid flow rates the passages 192 may be equipped with moveable walls 201 which serve to vary the area of the turbine inlets 186.

Accordingly, the FIGS. 12–16 embodiment provide, essentially, a moving surface to enable separation of the gas and liquid phases with extremely low friction, said surface comprising a first wheel having a periphery toward which the jet is tangentially directed, which is free to rotate, and including means to capture first fluid which has been separated from the second and has acted to impart rotation to the wheel but with essentially no power transfer. Also, they provide a second wheel having a periphery extending in proximity with the periphery of the first wheel whereby the two wheels define a gap therebetween to receive the separated first fluid A and supply the fluid to the second wheel wherein the kinetic energy of the fluid is converted partly to shaft power and partly to pumping power.

FIGS. 17–19 illustrate a highly efficient turbine wheel 300 having blades 301 to convert the kinetic energy of a two-phase jet into power at shaft 302. As best seen in FIG. 19, each blade has a generally straight first surface portion or portions 303 to receive jet impingement, and inclined forwardly and transversely relative to the forward direction of travel (indicated by arrow 305) of the impinging jet 306 to effect separation of the first fluid in liquid state from the second fluid and so that the separated liquid forms a continuous film (as for example at 307) on the straight surface portion. Thus, in the example, the first surface portion (or portions) is inclined at a gradual angle $\alpha$ (10° to 30°) to the flow direction 305, so that film 307 may be formed with minimum momentum loss.

The FIGS. 17–19 blade section also has a concavely (for example circularly) curved second surface portion 308 merging with straight surface portion 303 to receive the liquid film and to turn it through a large angle to travel generally reversely relative to the impinging direction, as seen at 307*a*, transferring momentum of the flow to the rotor; further, the total rearwardly projected area (indicated at 320) of the second surface portion is less than one-half the projected area (indicated at 321) of the impinging extent of the two-phase jet, for most efficient operation.

Referring again to the nozzle structure, as for example is seen in FIG. 9, it provides very uniform initial sub-division and distribution across the entire nozzle cross section of the two-phases, either in gas and liquid states, or with both in the liquid state. The nozzle contour minimizes the local velocity difference between the gas and liquid at any point, for either constant ratio of gas and liquid, or for varying ratios resulting from vaporization or dissolutions of the different phases or components, in order to minimize the energy dissipation due to friction between the two phases.

FIG. 20 illustrates the fact that the engine variation of FIG. 4 produces a large torque when the output shaft is not rotating. This highly desirable condition (as for vehicle use) may be achieved with no auxiliary power supplies for the appurtenance equipment employed to effect recirculation of the first and second fluids, as is clear from the description.

Further, the means to supply heated first fluid in liquid state to the nozzle may include another nozzle and rotor, or nozzle, separator, and diffuser, communicating with the casing to receive the first and second fluids therefrom, with the second fluid in the vaporized and pressurized state, the second fluid expanding to higher pressure in the first nozzle, retaining enthalpy for expansion in the second nozzle, each nozzle operating with a lower velocity to provide lower rotor velocity than would be possible with a single nozzle and rotor. The second nozzle and rotor combination may be followed by any number of other nozzle and rotor combinations, the speed being proportional in the ideal case to the one-half power of the number of nozzle-rotor combinations. All rotors may be affixed to a common drive shaft producing a drive shaft speed lower by the one-half power of the number of combinations than would occur for a single stage.

Further, each fluid may be subdivided before introduction to the first nozzle, with portions of each fluid being diverted to a second nozzle in parallel to the first nozzle wherein they are accelerated to produce power in a second rotor which rotates independently of the first rotor to provide all parasitic power requirements. This enables the first rotor to have a high torque at zero shaft speed and enables the engine to operate in a self sustaining fashion at zero shaft speed. The flows from both rotors and rotor casings may be merged to form a single stream of the first fluid, which is circulated through a heat exchanger, which may receive heat from any suitable source, back to the nozzles, and a single stream of the second fluid which is condensed and circulated back to the nozzles.

We claim:

1. In a two-phase power source, the combination comprising a. a rotor having blades, b. a nozzle having an outlet directed to discharge a two-phase jet forwardly for impingement on the rotor to rotate same, the nozzle having means to subdivide flow therein, and c. means to supply a heated first fluid in liquid state to the nozzle for subdivided flow therein toward said outlet and to supply a second and vaporizable fluid in liquid state to the nozzle to receive heat from the first fluid therein causing the second fluid to vaporize in the nozzle and mix with the first fluid in essentially liquid state to produce said discharging jet, d. each of said blades having, in section, a generally straight surface portion to receive jet impingement, said portion inclined forwardly and transversely relative to the forward direction of travel of the impinging jet to effect separation of the first fluid in liquid state from the second fluid and so that the separated liquid forms a continuous film on said straight surface portion, the blade section also having a concavely curved surface portion merging with said straight surface portion to receive the liquid film therefrom and to turn the film to travel generally reversely relative to said impinging direction, the total rearwardly projected area of said second surface portion being less than one-half the rearwardly projected area of the impinging jet extent.

2. The combination of claim 1 including a casing in which the first liquid separating from the rotor collects.

3. The combination of claim 1 including a casing for the rotor and wherein the first and second fluids collect after separation from the rotor.

4. The combination of claim 3 wherein said means includes a first path for first fluid recirculation to the nozzle and a second path for second fluid recirculation to the nozzle, a heater to heat first fluid flowing in said first path and a condenser to condense vaporized second fluid flowing in said second path.

5. The combination of claim 4 wherein the condenser includes a vapor duct, separate fluid coolant ducts extending in heat transfer relation with the vapor ducts, there being a heat radiator having segmented passages in communication with the respective separate fluid coolant ducts, which contain a vaporizable fluid for heat transport, said condenser enabling operation of the engine to continue in the event of rupture or damage to at least one heat radiator segment.

6. The combination of claim 1 including a vehicle having supporting wheel means to which said rotor is operatively connected in driving relation.

7. In a two-phase power source, the combination comprising a. first and second turbine rotors having independent shafts, blades and power take-offs, b. first and second nozzles having outlets respectively directed to discharge two-phase jets for impingement on the respective rotor blades to rotate the rotors, c. means to supply a heated first fluid in liquid state to each nozzle for flow therein toward the nozzle outlet, and to supply a second and vaporizable fluid to each nozzle to receive heat from the first fluid therein causing the second fluid to expand in the nozzle and mix with the first fluid in essentially liquid state to produce said discharging jets, d. pump means and appurtenance equipment driven by one rotor power take-off at substantially constant rotary speed for recirculating at least one of the fluids to the nozzles after fluid separation from the rotors, and the other power take-off being operatively connectible to a variable speed load, enabling self sustaining operation at zero speed and having a high torque at zero speed, e. each of said blades having, in section, a generally straight surface portion to receive jet impingement, said portion inclined forwardly and transversely relative to the forward direction of travel of the impinging jet to effect separation of the first fluid in liquid state from the second fluid and so that the separated liquid forms a continuous film on said straight surface portion, the blade section also having a concavely curved surface portion merging with said straight surface portion to receive the liquid film therefrom and to turn the film to travel generally reversely relative to said impinging direction, the total rearwardly projected area of said second surface portion being less than one-half the rearwardly projected area of the impinging jet extent.

8. The combination of claim 7 including said load in the form of a vehicle drive.

9. The combination of claim 7 including a first path for first fluid recirculation to the nozzles and a second path for second fluid recirculation to the nozzles, said pump means including a first pump connected in series with said first path.

10. The combination of claim 9 wherein said pump means includes a second pump connected in series with the second path.

11. The combination of claim 10 including a condenser and a regenerative heat exchanger having a first inlet receiving vapor from the rotor and a first outlet passing cooled vapor to the condenser, the condenser having an outlet connected with the second pump, and the heat exchanger having a second inlet connected with the second pump discharge and a second outlet connected with the second path.

* * * * *